US005961276A

United States Patent [19]

Huebel et al.

[11] Patent Number: 5,961,276

[45] Date of Patent: Oct. 5, 1999

[54] AGGREGATE FOR FEEDING A FUEL FROM TANK TO AN INTERNAL COMBUSTION ENGINE OF A MOTOR VEHICLE

[75] Inventors: Michael Huebel, Gerlingen; Willi Strohl, Beilstein; Jochen Rose, Hemmingen, all of Germany

[73] Assignee: Robert Bosch GmbH, Stuttgart, Germany

[21] Appl. No.: 09/065,993

[22] Filed: Apr. 24, 1998

[30] Foreign Application Priority Data

May 9, 1997 [DE] Germany ..... 197 19 609

[51] Int. Cl.[6] ..... F04D 5/00

[52] U.S. Cl. ..... 415/55.1

[58] Field of Search ..... 415/55.1, 55.2, 415/55.3, 55.4

[56] References Cited

U.S. PATENT DOCUMENTS

| | | | |
|---|---|---|---|
| 5,123,809 | 6/1992 | Ito | 415/55.1 |
| 5,807,068 | 9/1998 | Dobler et al. | 415/55.1 |

FOREIGN PATENT DOCUMENTS

| | | |
|---|---|---|
| 2 653 833 | 5/1991 | France . |
| 729 453 | 12/1942 | Germany . |
| 44 11 627 A1 | 10/1995 | Germany . |
| 195 04 079 A1 | 8/1996 | Germany . |
| 196 22 560 A1 | 12/1997 | Germany . |

*Primary Examiner*—Thomas N. Moulis
*Attorney, Agent, or Firm*—Micheal J. Striker

[57] ABSTRACT

The aggregate has a feed pump formed as a flow pump (10) comprising an impeller (12) rotating in a pump chamber (24) which has a peripheral rim of vanes (32) on respective opposite sides of the impeller which together with opposing side walls (26,28) bounding the pump chamber (24) form respective lateral feed ducts (44). The vanes (32) of the impeller (12) are connected with each other by an outer ring (36) at their outer radial ends. The outer ring (36) of the impeller (12) similarly has respective additional rims of additional vanes (101) on opposite sides thereof. Both additional vane rims are separated from each other by an annular separating member (102) placed between them in an axial direction. The additional vanes (101) are arranged in succession with equal spacing (e) in a rotation direction around the impeller and are shaped to optimize fluid flow. The additional vanes (101) of the outer ring (36) together with the opposing side walls (26,28) and/or the annular wall (30) form at least one arc-shaped flow duct (94) extending around a rotation axis (13) of the impeller (12) in which a pressure build-up occurs in a rotation direction (11) of the impeller (13).

11 Claims, 7 Drawing Sheets

AGGREGATE FOR FEEDING A FUEL FROM TANK TO AN INTERNAL COMBUSTION ENGINE OF A MOTOR VEHICLE

BACKGROUND OF THE INVENTION

The present invention relates to an aggregate for feeding fuel from a fuel tank to an internal combustion engine of a motor vehicle and, more particularly, to an aggregate for feeding fuel from the fuel tank to an internal combustion engine comprising a feed pump formed as a flow pump, the flow pump comprising a rotatable impeller arranged in a pump chamber and a drive member for rotatably driving the impeller about a rotation axis, two opposing walls facing in opposite directions along the rotation axis of the impeller, wherein the impeller has two opposite sides and a peripheral rim of radially exteriorly directed vanes on each side, the vanes being spaced from each other in a circumferential direction, the impeller is provided with a circular arc-shaped groove in each side and the circular arc-shaped grooves extend partially circumferentially around the rotation axis of the impeller at a distance from the rotation axis approximately equal to a distance of the vanes from the rotation axis so that the grooves together with the vanes of the impeller form respective feed ducts, each arc-shaped groove has a beginning and an ending along a circumferential extent thereof in a rotation direction of the impeller and are provided with an inlet opening at its beginning and an outlet opening at its end, the vanes of the impeller have radial outer ends and an outer ring connected to the vanes at the radial outer ends, the impeller has an additional peripheral rim of radially exteriorly directed additional vanes on each side, the additional vanes being spaced from each other in a circumferential direction, the additional vanes of the additional rims together with the opposing walls and/or the annular wall forming at least one flow duct extending circumferentially in an at least partially circular arc-shaped manner around the rotation axis of the impeller, so that a pressure build-up occurs in the rotation direction of the impeller.

This aggregate is described in German Patent Application DE 196 22 560. It has a feed pump formed as a flow pump, whose impeller rotates in a pump chamber and is rotatably driven by a drive device. The pump chamber is bounded in a direction along the rotation axis of the impeller by two opposing walls and by an annular ring in a radial direction relative to the rotation axis. The impeller has a peripheral rim of vanes on its circumference on each of its opposite sides. In both side walls a groove extends circumferentially about the rotation axis over a portion of its circumference spaced from the rotation axis at about the same distance as the vanes are from the rotation axis. Each groove together with the opposing vanes of the impeller form a feed duct. The feed ducts lead from an inlet opening at one end to an outlet opening at their other end. The impeller has an outer ring connected to its vanes at their radially outwardly directed ends. An additional rim of additional radially outwardly directed vanes spaced from each other in a circumferential direction, which form together with the opposing walls and/or with the annular wall of the pump chamber at least one flow duct extending in an at least partially arc-shaped manner about the rotation axis of the impeller, in which a pressure build-up occurs in a rotation direction of the impeller. The foregoing structural features of the flow pump of the aggregate reduce a space of the feed ducts in the space between the outer ring of the impeller and the opposite walls and the annular wall and also the introduction of dirt particles into that space.

SUMMARY OF THE INVENTION

It is an object of the present invention to provide an improved aggregate for feeding a fuel from a fuel tank to an internal combustion engine of a motor vehicle in which the above-described disadvantages are further reduced or eliminated.

These objects, and others which will be made more apparent hereinafter, are attained in an aggregate for feeding a fuel from a fuel tank to an internal combustion engine of a motor vehicle comprising a feed pump formed as a flow pump, the flow pump comprising a rotatable impeller arranged in a pump chamber and a drive member for rotatably driving the impeller about a rotation axis, two opposing walls bounding the pump chamber in opposite directions along the rotation axis of the impeller and an annular wall bounding the pump chamber in a radial direction relative to the rotation axis of the impeller. The impeller has a peripheral rim of radially exteriorly directed vanes on each side of the impeller spaced from each other in a circumferential direction. The impeller is provided with a circular arc-shaped groove in each side and the circular arc-shaped grooves extend partially circumferentially around the rotation axis of the impeller at a distance from the rotation axis approximately equal to a distance of the vanes from the rotation axis so that the grooves together with the vanes of the impeller form respective feed ducts. Each of the arc-shaped grooves has a beginning and an ending along a circumferential extent thereof in a rotation direction of the impeller and are provided with an inlet opening at its beginning and an outlet opening at its end. The vanes of the impeller have an outer ring connected to the vanes at their radial outer ends. The impeller has an additional peripheral rim of radially exteriorly directed additional vanes on each side in the outer ring and the additional vanes are spaced from each other in a circumferential direction. The additional vanes of the additional rims together with the opposing walls and/or the annular wall form at least one flow duct extending circumferentially in an at least partially circular arc-shaped manner around the rotation axis of the impeller so that a pressure build-up occurs in the rotation direction of the impeller.

According to the invention, the additional rim of additional vanes in the outer ring of the impeller is divided into two rim portions of the additional vanes on respective opposite sides of the outer ring, the two rim portions are separated from each other in an axial direction by an annular separating member of the outer ring, and the additional vanes are arranged with equal spacing (e) in a rotation direction of the impeller and are shaped to optimize fluid flow.

The aggregate according to the invention for feeding a fuel from a fuel tank to an internal combustion engine of a motor vehicle has the advantages that its operation is improved further and the introduction of dirt particles into the flow duct is further reduced.

Various preferred embodiments of the aggregate according to the invention are described and claimed in the appended dependent claims.

BRIEF DESCRIPTION OF THE DRAWING

The objects, features and advantages of the invention will now be illustrated in more detail with the aid of the following description of the preferred embodiments, with reference to the accompanying figures in which.

DESCRIPTION OF THE PREFERRED EMBODIMENTS

Figure 1:
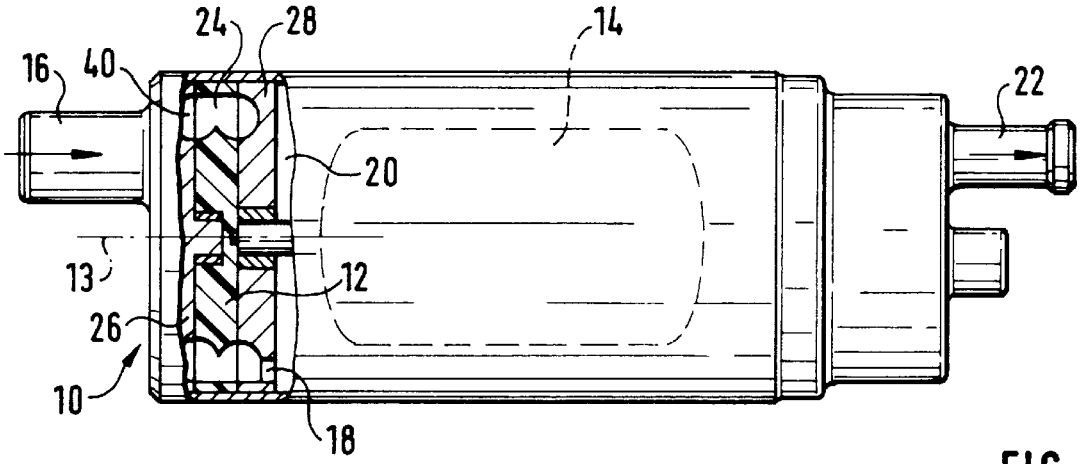
FIG. 1 is a partially axial cross-sectional, partially side view of an aggregate according to the invention for supplying a fuel with a flow pump.
Figure 2:
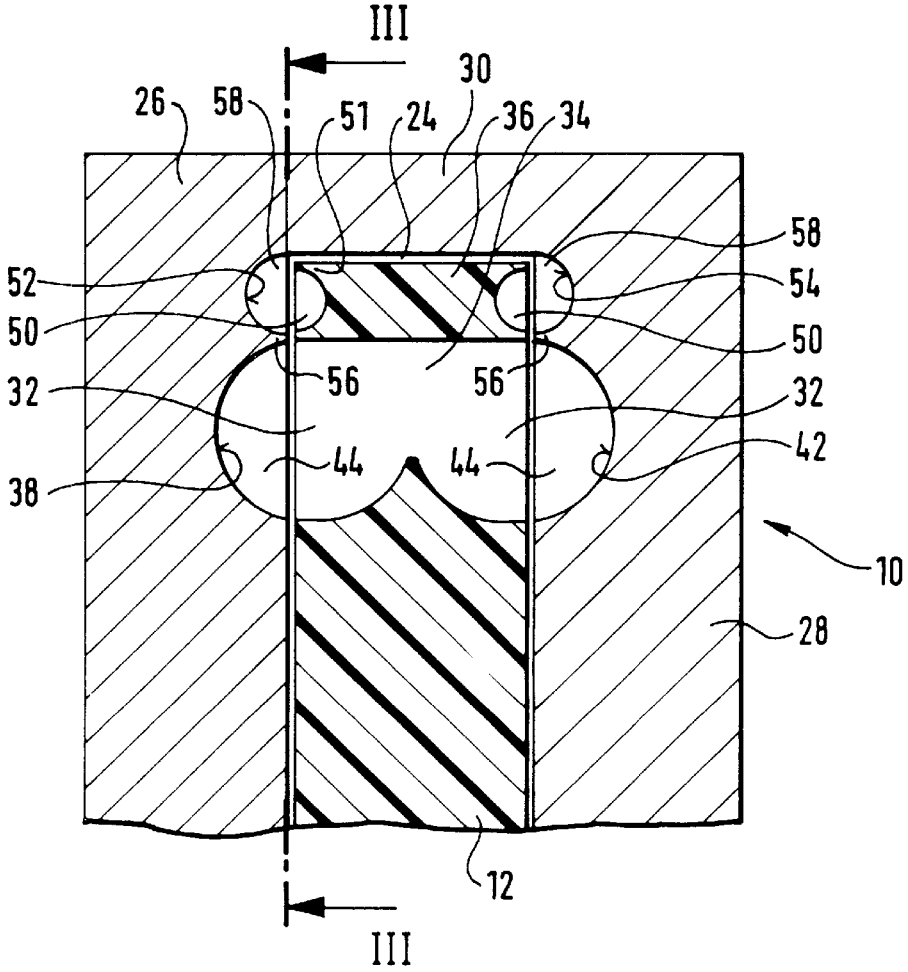
FIG. 2 is a detailed cutaway axial cross-sectional view of a first embodiment of a flow pump.

An aggregate shown in a simplified form in FIG. 1 feeds fuel from an unshown fuel tank to an unshown internal combustion engine of a motor vehicle. The fuel supplying aggregate has a flow pump 10, whose impeller 12 is driven rotatably by an electrical drive motor 14. During operation of the fuel supplying aggregate the flow pump 10 draws fuel through a vacuum connection 16 and forces it through a pump outlet 18 in a downstream wall into a chamber 20, in which the driven motor 14 is arranged. From there the fuel is fed by means of a pressurized connection 22 and an unshown fuel line to the internal combustion engine.

The fuel pump 10 is shown in detail in FIGS. 2 to 10. The impeller 12 of the flow pump 10 rotates in a pump chamber 24. The pump chamber 24 is bounded in a direction along the rotation axis 13 of the impeller 12 by opposing walls 26 and 28 and is bounded in a radial direction relative to the rotation axis 12 by an annular wall 30. One wall 26 can thus form a cover of the fuel supplying aggregate, in which the vacuum connection 16 is arranged. The other wall 28 can form a separating wall for the chamber 20 and has the pump outlet 18 in the form of a throughgoing outlet opening. The impeller 12 has a peripheral rim of radially outwardly directed vanes 32 spaced from each other around its circumference on both of its opposite sides. The vanes 32 are formed by crosspieces between throughgoing holes 34 arranged on a common circular arc or path around the rotation axis 12. The crosspieces bound the throughgoing holes 34 in a circumferential direction around the impeller 12. The vanes 32 are connected with each other by a closed outer ring 36 at their radial outer ends.

Figure 3:
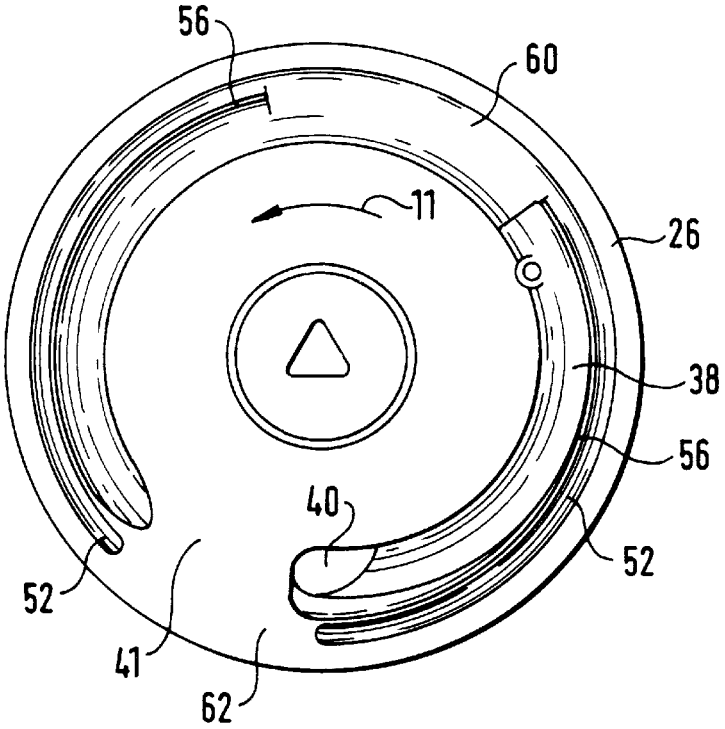
FIG. 3 is a transverse cross-sectional view through the flow pump shown in FIG. 2 taken along the section line III—III in FIG. 2.
Figure 4:
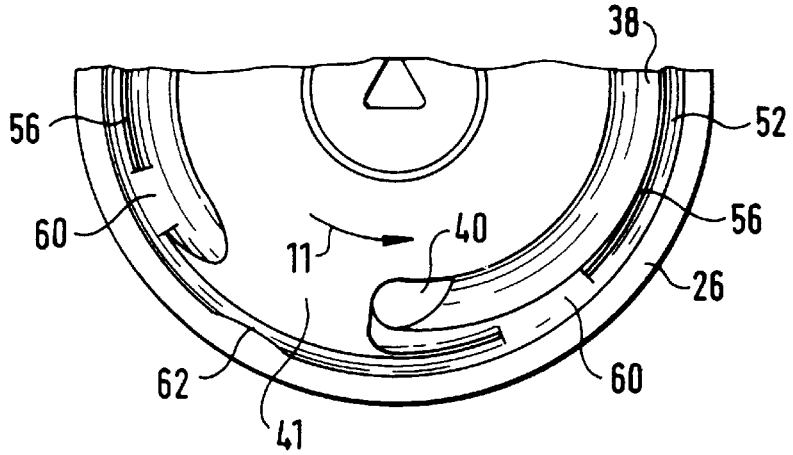
FIG. 4 is a cutaway transverse cross-sectional view through a modification of the embodiment shown in FIG. 3.

In the one wall 26 upstream of and facing the impeller 12 an arc-shaped groove 38 extends around the rotation axis 13 of the impeller 12 at about the same distance from the rotation axis 13 as the vanes as shown in FIG. 3. An entrance opening 40 communicating with the vacuum connector 16 is arranged at the beginning of the arc-shaped groove 38 along a circumferential extent thereof viewed in the rotation direction 11 of the impeller 12 (FIGS. 3 and 4). The groove 38 is discontinued in a peripheral region 41 between its end and its beginning along the circumferential extent thereof in a rotation direction 11 of the impeller 12. Similarly an arc-shaped groove 42 extends about the rotation axis 13 of the impeller 12 spaced from the rotation axis 11 about the same distance as the vane 32 in the other wall 28 facing the impeller 12. The pump outlet 18 leads away from the end of the groove 42 along the circumferential extent the rotation direction 11 of the impeller 12. The groove 42 is similarly interrupted in a peripheral region between its end and its beginning along its circumferential extent in the rotation direction 11 of the impeller 12 shown by the arrow in FIGS. 3 and 4. The grooves 38 and 42 form respective feed ducts 44 together with the vanes 32 on the opposite sides of the impeller 12 facing them, in which the fuel is fed from the inlet opening 40 to the outlet opening 18 in operation of the fuel supplying aggregate. The flow pump 10 is thus formed as a side channel pump, since the feed ducts 44 are formed only laterally next to the impeller 12 and do not extend over the outer circumference of the impeller 12.

The impeller 12 has an additional peripheral rim of additional vanes 50 arranged spaced from each other in a circumferential direction on its opposite sides facing the walls 26 and 28 in its outer ring 36 in a first embodiment of the flow pump shown in FIGS. 2 to 5. The additional vanes 50 are connected with each other at their outer radial ends by a ring 51 radially bounding the impeller from the exterior. The additional vanes 50 can lead with their radial outer ends, advantageously about 25° to 50°, in the rotation direction 11 of the impeller 12 in order to minimize the fluid mechanical energy losses. For this the subject matter of German Patent Application 195 04 079 is incorporated herein by reference. The facing walls 26 and 28 have an arc-shaped or circular going ring extending around the rotation axis 13 of the impeller at about the same level as the additional vanes 50. The grooves 52 and/or 54 extend circumferentially at least approximately about the same extent as the feed duct 44 with grooves 38 and/or 42 formed in the opposing walls 26,28. The grooves 52 and/or 54 also extend circumferentially to an approximately lesser or greater extent then the grooves 38 and/or 42. The outer grooves 52,54 are separated from the inner grooves 38,42 over a portion of their periphery by crosspieces 56 of the opposing walls 26,28. The outer grooves 52,54 form respective outer flow ducts 58 with the additional vanes 50 on respective opposite sides of the outer ring 36 of the impeller 12 facing them. A pressure build-up should occur in the outer flow ducts 58 in operation of the fuel supplying aggregate, which at least approximately corresponds to the build-up of pressure in the feed ducts 44.

The outer flow ducts 58 are connected with the feed ducts 44 radially inside of them over a portion of their periphery. The grooves 52,54 forming the outer flow ducts 58 can be connected with the inner grooves 38,42 forming the feed ducts 44 in the vicinity of their beginning along a circumferential extent in a rotation direction 11 of the impeller 12 and/or in the vicinity of their end as viewed along their circumferential extent. These connections can be made by one or more cavities or gaps penetrating the crosspieces 56. Preferably a connection with the inner grooves is made both at the beginning and at the end of the outer flow ducts 58, so that approximately the same pressure conditions occur at the beginning and at the end of the outer flow ducts 58 as at the beginning and end of the inner feed ducts 44 as in FIG. 4. Alternatively the connection of the outer grooves 52,54 with the inner grooves 38,42 can be made as in FIG. 3 between their beginning and their end, also in a central peripheral region, similarly by one or more gaps or cavities 60 interrupting the crosspieces 56. The width, depth and position of the gaps or cavities 60 is thus determined or designed so that satisfactory flow conditions occurs between the grooves and a pressure balancing between occurs.

The outer flow ducts 58 are interrupted or at least narrowed in peripheral region 62 between their beginnings and endings along their circumferential extent in the rotation direction 11 of the impeller 12. The peripheral region 62 corresponds substantially to the peripheral region 41 in which the inner grooves are interrupted, however it can be somewhat larger or smaller than it. In an embodiment shown in FIG. 3 the outer grooves 52,54 are completely separated and interrupted in the peripheral region 62 between their ends and beginnings along their circumferential extent in the rotation direction 11 of the impeller 12. The grooves 52,54 in the peripheral region 62 are narrowed or constricted in a modified embodiment shown in FIG. 4. For example, a narrowing or constriction can be provided in the radial direction, which means reducing the width of the groove and/or in the direction of the rotation axis 13 of the impeller, which means reducing the depth of the grooves 52,54. The groves 52,54 in the peripheral region 62 are displaced radially relative to their remaining extent, for example further radially, so that here no, or only a slight, overlap with the additional vanes 50 of the outer ring 36 of the impeller 122 occurs and the flow ducts 58 are appropriately interrupted or at least narrowed or constricted.

The additional vanes 50 of the outer ring 36 of the impeller 12 together with the grooves 52,54 forms an additional flow pump, which is similarly a lateral duct pump, since the flow ducts 58 are arranged only laterally next to the impeller 12 and have no connection via the ring 51 to the outer circumference of the impeller 12. This additional flow pump is however not connected downstream to the first inner flow pump as in the known multistage feed pump, but feeds the fuel so-to-speak parallel to it from the inlet opening 40 to the same outlet opening 18. In operation of the fuel supplying aggregate the fuel is also fed by the additional vanes 50 arranged in the outer ring 36 of the impeller 12 in the flow ducts 58. The flow rate of the fuel, which depends on the rotation speed of the impeller 12 and the course of the pressure build-up over the circumference of the flow ducts 58 can be influenced by the form of the vanes 50 and the grooves 52,54 and the form or shape of the interruptions and/or constrictions of the flow ducts 58, so that a desired fuel supply rate and a desired pressure build-up can be attained by appropriate structural features.

Figure 6:
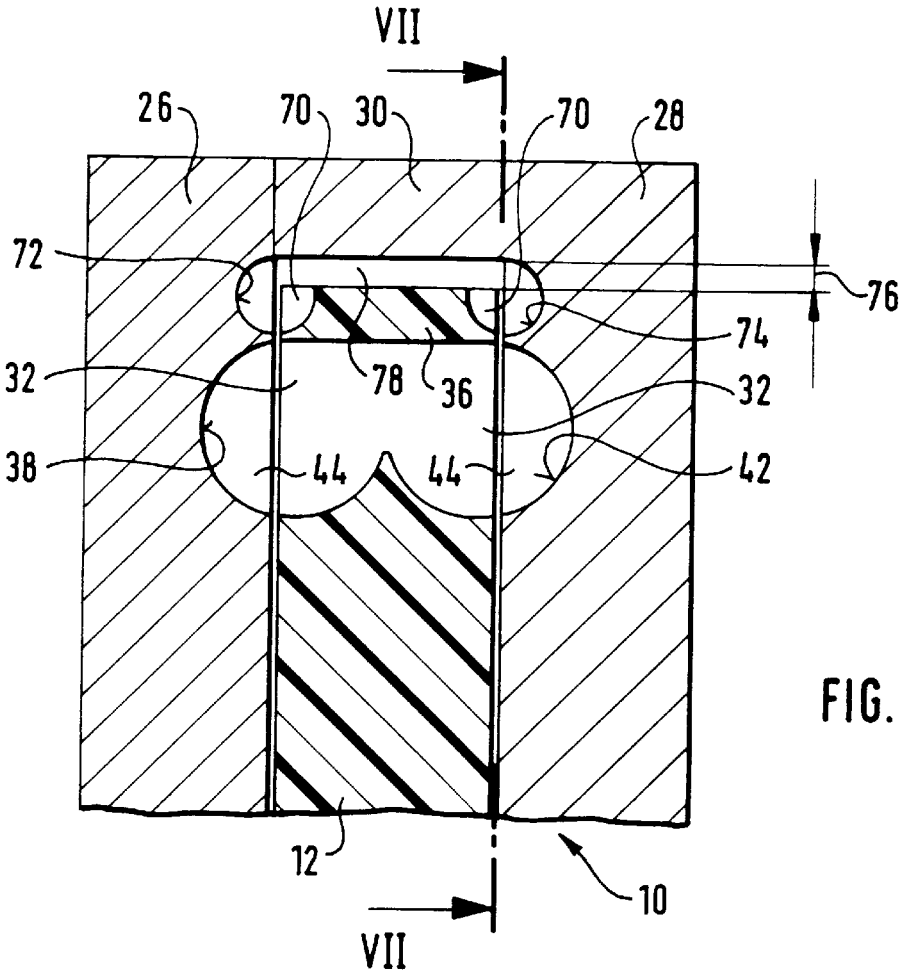
FIG. 6 is a detailed cutaway axial cross-sectional view of a second embodiment of a flow pump.
Figure 7:
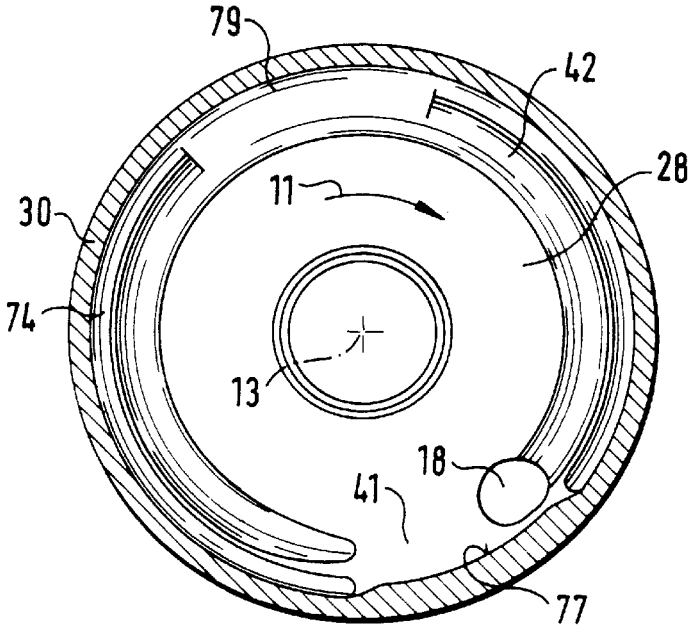
FIG. 7 is a transverse cross-sectional view through the flow pump shown in FIG. 6 taken along the section line VII—VII in FIG. 6.
Figure 8:
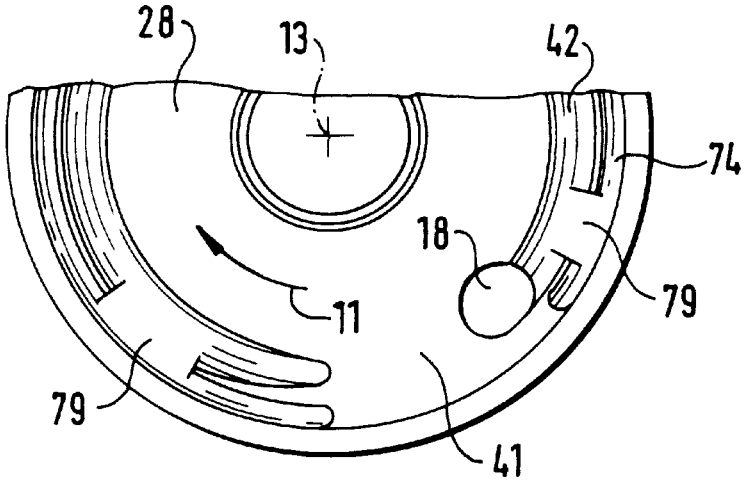
FIG. 8 is a cutaway transverse cross-sectional view through a modification of the embodiment shown in FIG. 7.

A flow pump 10 formed according to a second embodiment is shown in FIGS. 6 to 8. The impeller 12 similarly has a additional peripheral rim of additional vanes 70 spaced from each other in a circumferential direction in its outer ring 36 in its opposite sides facing the walls 26,28, which however extend to the outer peripheral surface of the outer ring 36 of the impeller in contrast to the first embodiment. The opposing walls 26,28 have respective arc-shaped grooves 72 and 74 extending around the rotation axis 13 of the impeller 12 at about the same distance from the rotation axis 13 as the additional vanes 70. The grooves 72 and 74 extend approximately over about the same circumferential extent as the grooves 38 and 42 of the side walls 26,28 forming the feed ducts 44. However they can also be somewhat smaller or somewhat larger than the grooves 38 and 42. A radial gap remains between the outer periphery of the outer ring 36 of the impeller 12 and the annular wall 30, by which the grooves 72,74 are connected with each over the outer periphery of the outer ring 36 of the impeller 12.

An outer flow duct 78 is formed by the additional vanes 70 of the outer ring 36 of the impeller 12 and the grooves 72,74 and the gap 76. The outer flow duct 78 is similarly interrupted or at least narrowed or constricted in the peripheral region 41, in which the inner feed ducts 44 are interrupted. In FIGS. 7 and 8 the other wall 28 with the grooves 42 and 74 is illustrated, which is a mirror image of the one wall 26 with the grooves 38 and 72. The grooves 72,74 in the opposing walls 26,28 can be interrupted in the peripheral region 41 as in FIGS. 7 and 8 or can be at least narrowed or constricted in their width and depth. Additionally or alternatively the radial gap 76 in the peripheral region 41 can be narrowed or reduced as is the case in a modified form shown in FIG. 7. A constriction or reduction of the gap 76 can be provided by a projection 77 extending radially interiorly toward the annular wall 30.

As in the first embodiment also in the second embodiment the outer flow duct 78 is connected with the inner feed ducts 44 in order to allow a pressure balancing between them. The connection can occur as in the first embodiment at the beginning and the end of the flow ducts 78 or in a peripheral region in between them. One or more cavities or openings 79 are provided in the intervening walls 26,28 for connection of the flow duct 78 with the feed ducts 44. The second feed pump formed by the additional vanes 70 of the outer ring 36 of the impeller 12 and the flow duct 78 is thus a combined lateral channel and peripheral pump, since the flow duct 78 extends both laterally next to the outer ring 36 of the impeller and over its outer circumference. The additional vane of the impeller, the dimensions of the flow duct 78 and the interruption and constriction of the flow duct 78 are designed so that a pressure build-up in the flow duct 78 in the circumferential direction of the impeller corresponds approximately to the pressure build-up in the feed ducts 44 and a predetermined fuel supply rate occurs.

Figure 9:
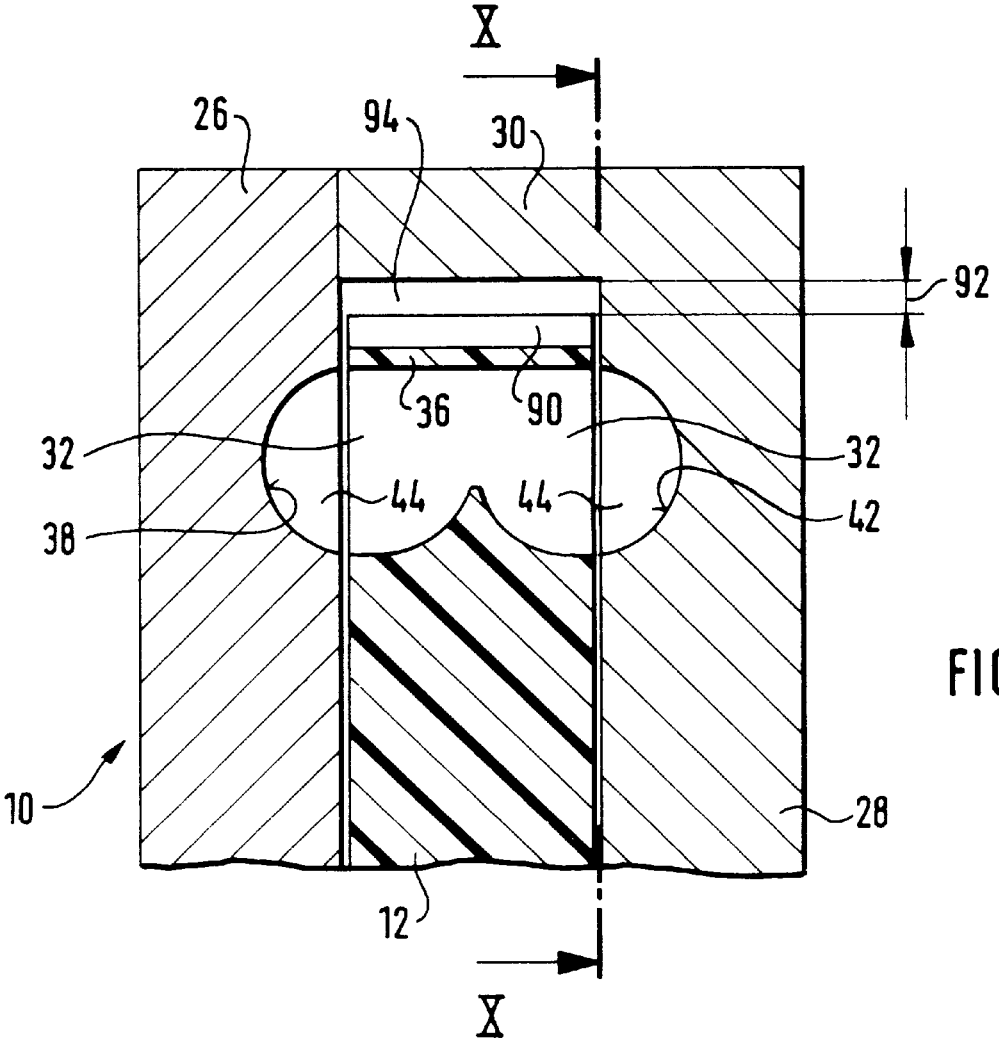
FIG. 9 is a detailed cutaway axial cross-sectional view of a third embodiment of a flow pump.
Figure 10:
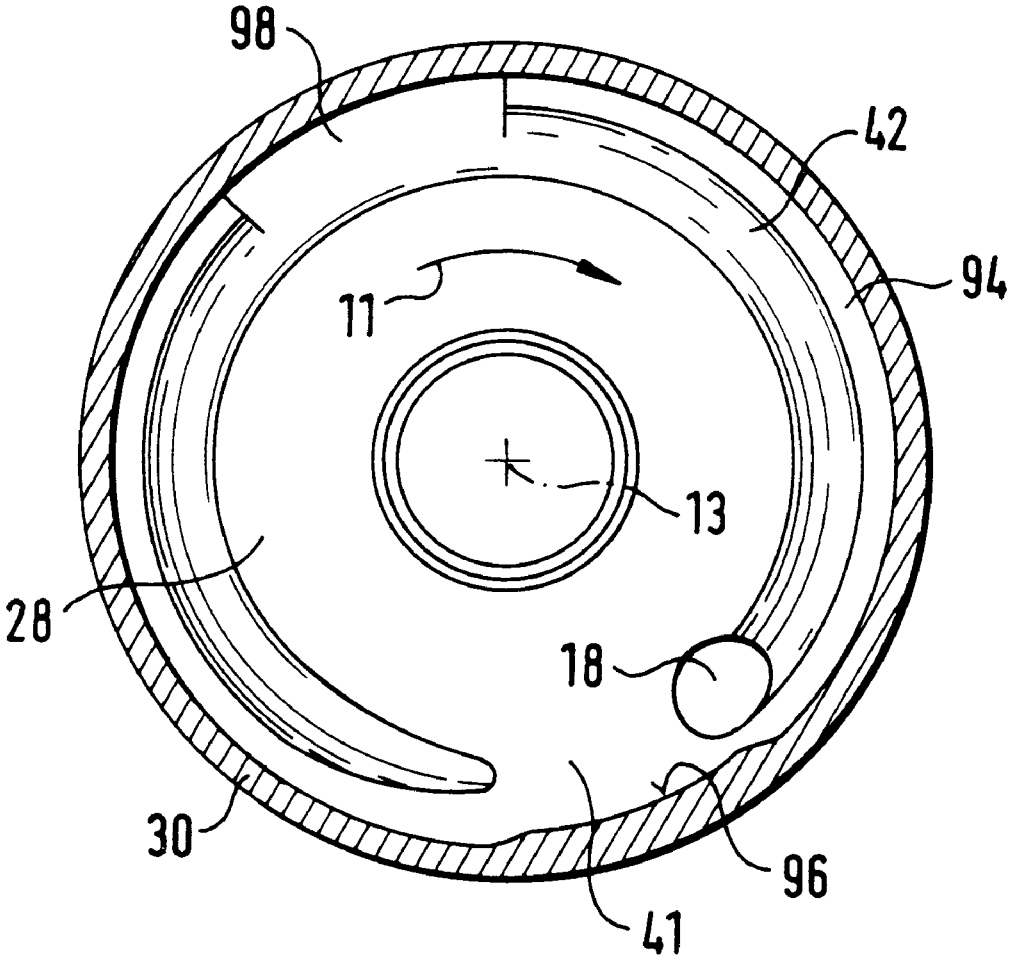
FIG. 10 is a transverse cross-sectional view through the flow pump shown in FIG. 9 taken along the section line X—X in FIG. 9.

A flow pump 10 according to a third embodiment is shown in FIGS. 9 and 10. The impeller 12 has a additional peripheral rim of additional vanes 90 spaced from each other in a circumferential direction in its outer ring 36, which extend radially outward from the outer ring 36. The vanes 90 can extend over the entire width of the impeller 12 or an additional peripheral rim of the vanes 90 can be arranged on the opposite sides of the outer ring 36. The radial gap 92 remaining between the radial outer ends of the additional vanes 90 and the annular wall 30 forms a flow duct 94 together with the additional vane 90 of the outer ring 36 of the impeller 12. The flow duct 94 extends approximately over the same circumferential extent as the inner feed ducts 44, but can of course have a somewhat larger or smaller circumferential extent than the inner feed ducts 44. The flow duct 94 is interrupted or at least narrowed between its beginning and ending as seen in the circumferential direction of the impeller 12 in about the same peripheral region 41 as the inner grooves 38 and 42. The interruption or narrowing of the flow duct 94 can occur since the radial gap 92 is reduced or narrowed more or less, which can occur by a projection 96 extending radially inward from the annular wall 30. In FIG. 10 the other wall 28 shown with the groove 42 is a mirror image of the opposite facing wall 26 with the groove 38.

The flow duct 94 is connected with the inner feed ducts 44 also in the flow pump according to the third embodiment.

The connection can occur in the region of the beginning and the end of the flow duct 94 along its circumferential extent in the rotation direction 11 of the impeller 12 or in a peripheral region between them. The connection of the flow duct 94 with the inner feed duct 44 can occur by one or more openings or cavities 98 in the opposite walls 26,28 as in the both previously described embodiments. The additional vanes 90 of the impeller 12, the dimensions of the flow ducts 94 and the interruption and constriction of the flow duct 94 can be designed so that a pressure build-up in the flow duct 94 in the circumferential direction of the impeller results in an approximately corresponding build-up in the feed ducts 44 and a predetermined fuel supply rate.

Figure 11:
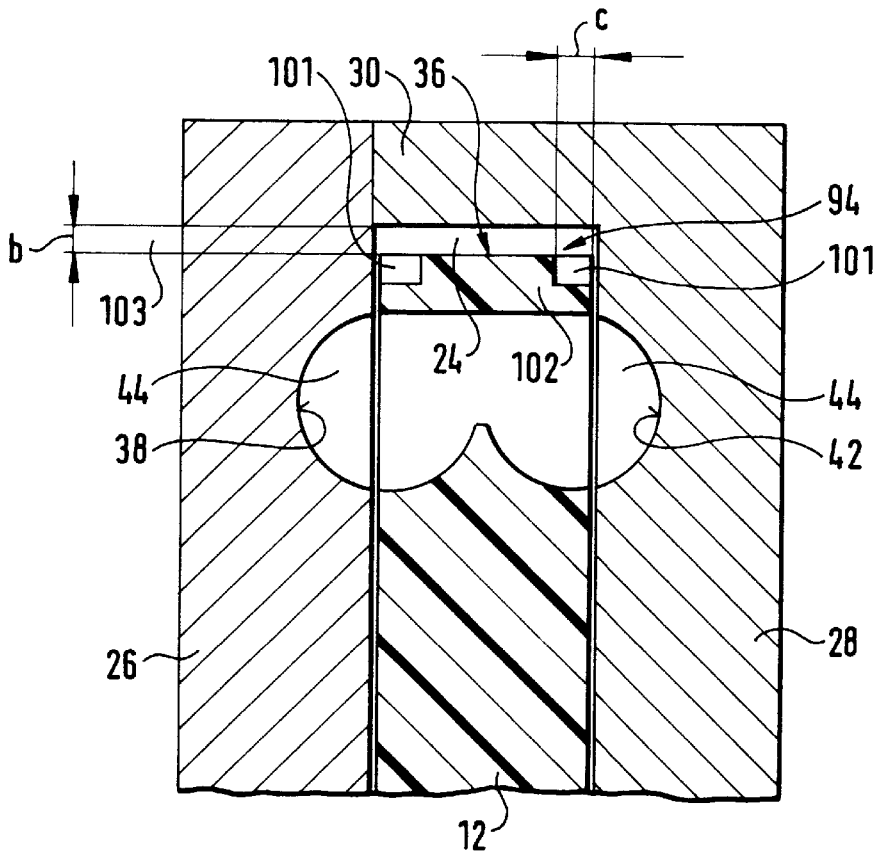
FIG. 11 is a detailed cutaway longitudinal cross-sectional view of a fourth embodiment of a flow pump.
Figure 12:
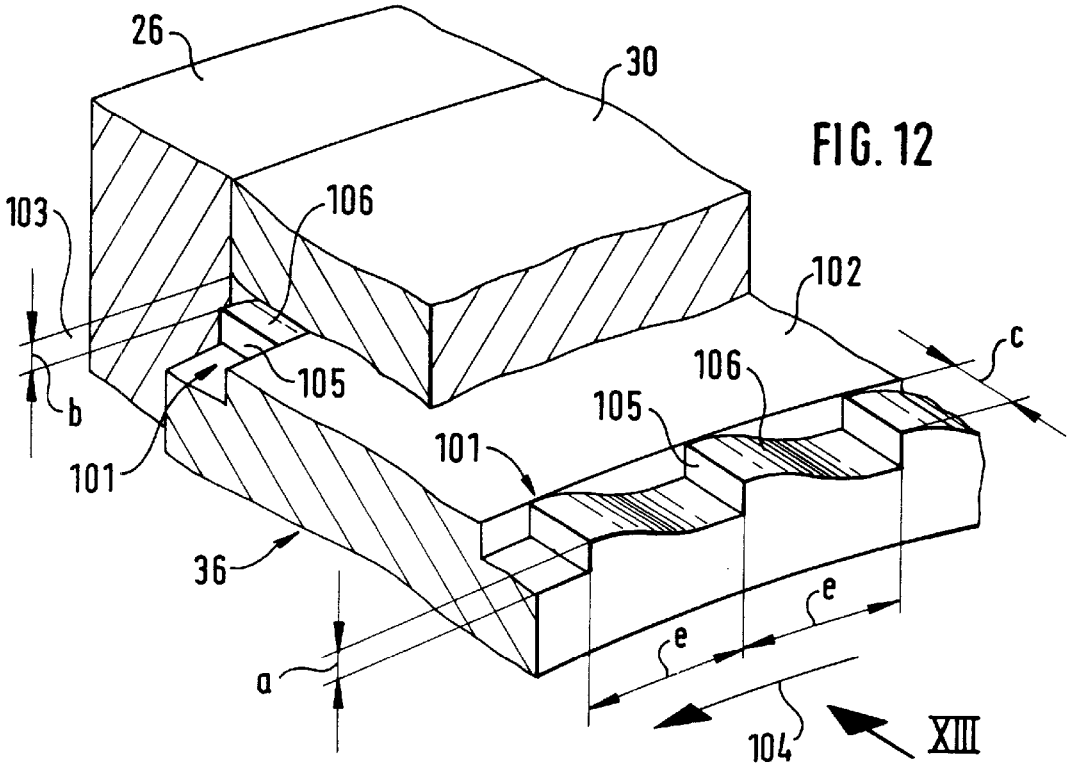
FIG. 12 is a detailed cutaway perspective view of a portion of an outer ring of an impeller of the flow pump shown in FIG. 11.

The flow pump according to a fourth embodiment is shown in longitudinal section in FIG. 11 in which the basic structure of the flow pump is as previously set forth in connection with the embodiment shown in FIGS. 9 and 10. FIG. 12 shows a detailed perspective view of a cutaway portion of a modified outer ring 36 in the impeller 12 and FIG. 13 a side view of the outer ring 36 in the direction of the arrow XIII in FIG. 12.

The vanes formed in the outer ring 36 of the impeller 36 do not extend over the entire width of the outer ring, but are divided into two rim portions of vanes 101, which are arranged on opposite sides of the outer ring 36. An annular separating member 102 with a smooth outer surface is between rim portions of the vanes 101, which bound the radial gap 103 with the annular wall 30 of the pump chamber 24, which, as shown in the embodiment of FIGS. 9 and 10, forms the flow duct 94.

Figure 13:
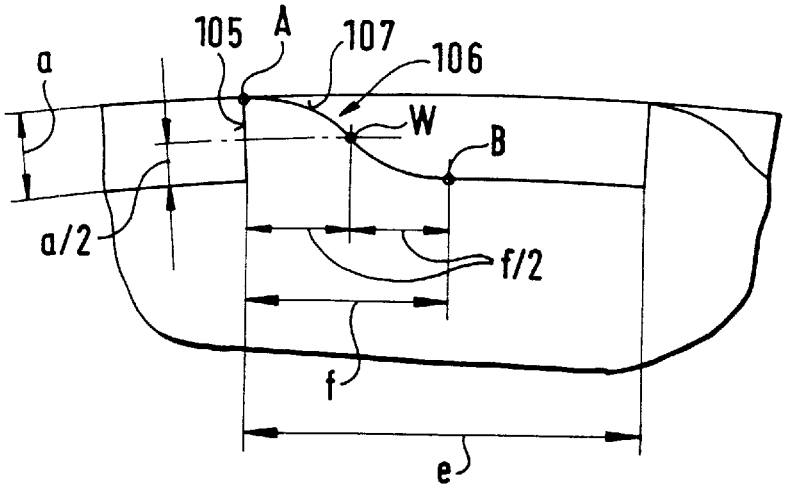
FIG. 13 is a detailed cutaway front view of the outer ring of the impeller as seen in the direction of the arrow XIII in FIG. 12.

The vanes 101 arranged successively with the same spacing e as in FIGS. 12 and 13 in the circumferential direction around the outer ring 36 as in FIGS. 12 and 13 are flow optimized in each vane rim portion, so that a pressure build-up is obtained in the annular or radial gap 103 with the radial maximum gap size b with reduced efficiency losses, which is sufficiently large so that a radial pressure balance between the flow duct 94 and the principle feed duct 44 formed in the opposite walls 26 and 28 by the grooves 38 and 42 is obtained. Because of that, a convection-dependent introduction of dirt particles into the radial gap 103 is prevented and thus the sensitivity of the flow pump to wear is substantially reduced.

The flow-optimized form of the vanes 101 with the axial width c arranged one after the other in the rotation direction of the impeller 12 indicated by the arrow 104 with spacing e is clearly visible in the cross-section through the outer ring 36 and the annular wall 30 shown in perspective in FIG. 12. Each vane 101 has a radially directed vane back 106 extending back in a circumferential direction of the outer ring 36, whose radial back height a is reduced from a maximum at the radial front surface 105 at the vicinity of point A in FIG. 13 continuously to a minimum at the end of the vane back 106 in the vicinity of the point B in FIG. 13. The outer contour 107 of the vane back 106 facing the annular wall 30 is curved or arc shaped with a intervening inflection point W between the maximum A and the minimum B. The arc-shaped outer contour 107 is thus formed or set up so that the tangents to the outer contour 107 at the maximum A and the minimum B intersect a radial line passing through the rotation axis 13 of the impeller 12 at right angles. The maximum radial height of the vane back 106 is indicated in FIG. 13 with a and the length of the vane back 106 is indicated with f in the circumferential direction in FIG. 13. The inflection point W is located at half the radial height a/2 and half the length f/2 of the vane back 106. A preferred vane embodiment has the following dimensions:

a=0.2 mm to 0.5 mm, b=0.1 mm to 0.3 mm, c=0.75 (a+b) to 1.25 (a+b), and f=0.5 to 0.75 e.

The vane spacing e is calculated from the outer diameter of the impeller 12 and the outer ring 36 and the number of the vanes 101 arranged in a rim, which preferably is selected to be between 37 and 50 vanes per rim. A reduction of the flow duct 94 is required for the pressure-build-upin the flow duct 94, which is provided by the projection 96 extending radially inwardly from the annular wall 30. Possibilities for pressure fine tuning in the radial gap 103 are provided by adjustments of the cross-sectional shape of the constriction or narrowing of the flow duct 94. The radial height of the radial gap 103 remaining minimal in the vicinity of the projection 96 is selected preferably between 0.03 and 0.1 mm with the above-described dimension of the vane 101.

Figure 14:
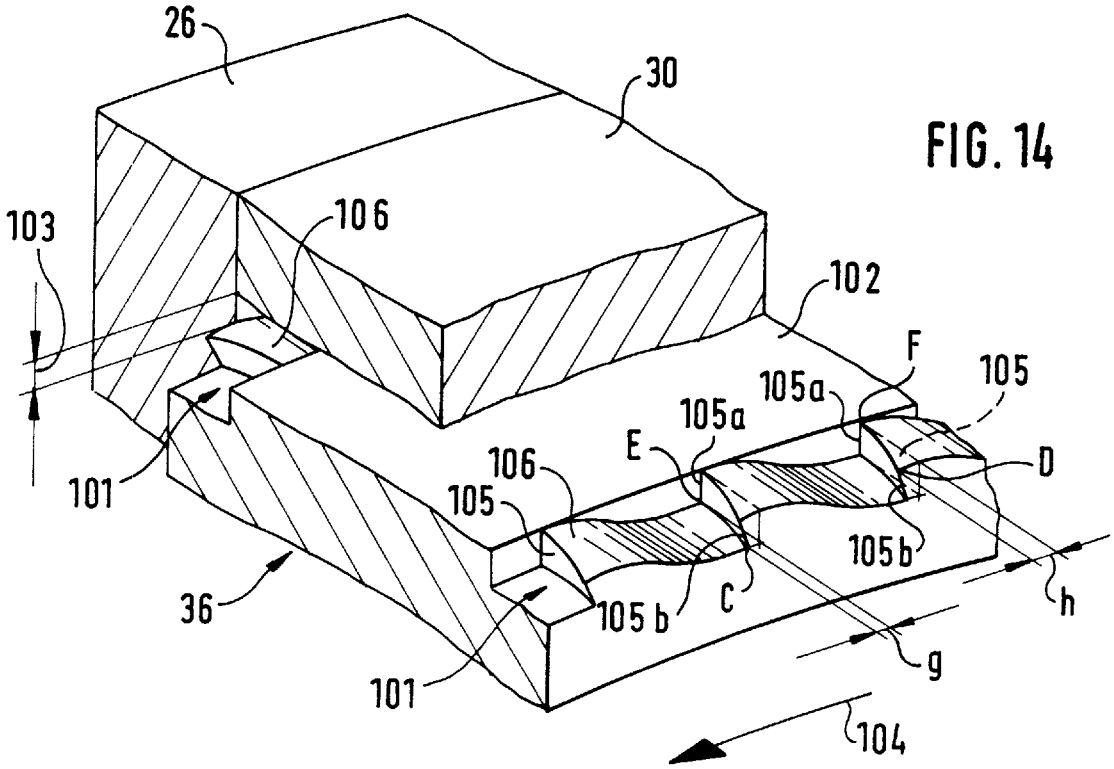
FIG. 14 is a detailed cutaway perspective view of an outer ring of the impeller.

In the perspective cutaway view of the outer ring 36 in FIG. 14 the vanes 101 are modified in so far as the vane front surface 105 extends from the radial surface edge 105*a* contacting the annular separating member 102, which follows a radial line passing through the rotation axis of the impeller, on a path or course to the surface edge 105*b* contacting on the facing side of the outer ring 36 which is rotated in the rotation direction 104 of the impeller 12 from the radial plane in which the front surface 105 of the vane 101 according to FIG. 12 lines so that both the radial interior lower corner point C of the facing surface edge 105*b* and the radial outer upper corner point D of the facing surface edge 105*b* are advanced in front of the corresponding corner points E and F of the annular crosspiece side surface edge 105*a* as seen in the rotation direction 104 of the impeller 12. The spacing as seen in the rotation direction 104 of the impeller 12 of the upper corner point D of the facing surface edge 105*b* from the upper corner point F of the annular crosspiece side surface edge 105*a* is indicated in FIG. 14 with h and the same space between the lower corner points C and E of both surface edges 105*a* and 105*b* is indicated with g. The spacing h is larger than the spacing g because of the curved rotation of the front surface 105 from the radial plane. It has proven to be advantageous when the spacing h amounts to approximately 0.5 to 0.8 times the maximum back height a of the vane 1010 and the spacing g amounts to from 0.2 to 0.5 times the maximum back height a. The described modification of the vanes 101 in FIG. 14 adds to the circulation flow and thus increase the pressure build-up in the radial gap 103. Of course an increased manufacturing expense is required for the curved front surface 105.

Figure 5:
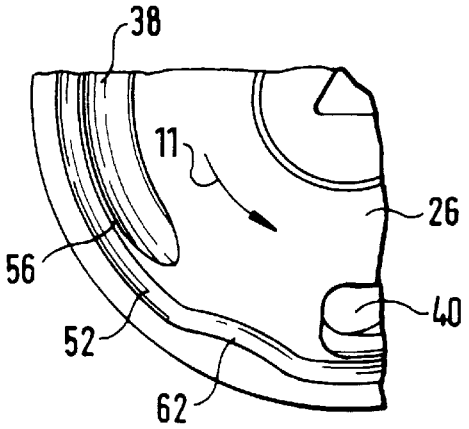
FIG. 5 is a cutaway transverse cross-sectional view through a further variation of the embodiment in FIG. 3.

The above described fluid flow optimized shape of the vanes 101 described in FIGS. 11 to 14 can also be provided in the flow pump according to the previously described first embodiment in FIGS. 1 and 5, the second embodiment according to FIGS. 6 to 8 and the third embodiment according to FIGS. 9 to 10.

The disclosure in German Patent Application 197 19 609.8 of May 9, 1997 is incorporated here by reference. This German Patent Application describes the invention described hereinabove and claimed in the claims appended hereinbelow and provides the basis for a claim of priority for the instant invention under 35 U.S.C. 119.

While the invention has been illustrated and described as embodied in an aggregate for feeding a fuel from a fuel tank to an internal combustion engine of a motor vehicle, it is not intended to be limited to the details shown, since various modifications and changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and is set forth in the following appended claims.

We claim:

1. An aggregate for feeding a fuel from a fuel tank to an internal combustion engine of a motor vehicle, said aggregate comprising a feed pump formed as a flow pump (10), said flow pump (10) comprising a rotatable impeller (12) arranged in a pump chamber (24) and a drive member (14) for rotatably driving said impeller about a rotation axis (13), two opposing walls (26,28) bounding the pump chamber (24) in opposite directions along the rotation axis (13) of the impeller (12) and an annular wall (30) bounding the pump chamber (24) in a radial direction relative to the rotation axis (13) of the impeller (12), wherein said impeller (12) has two opposite sides and a peripheral rim of radially exteriorly directed vanes (32) on each of said opposite sides thereof, said vanes (32) are spaced from each other in a circumferential direction, each of said two opposing walls (26,28) bounding the pump chamber (24) is provided with a circular arc-shaped groove (38,42) and said circular arc-shaped grooves extend partially circumferentially around the rotation axis (13) of the impeller (12) at a distance from the rotation axis approximately equal to a distance of said vanes from said rotation axis (13) so that said grooves (38,42) together with said vanes (32) of the impeller (12) form respective feed ducts (44), each of said arc-shaped grooves (38,42) has a beginning and an end along a circumferential extent thereof in a rotation direction (11) of said impeller (12) and is provided with an inlet opening (40) at said beginning and an outlet opening (18) at said end, the vanes (32) of the impeller (12) have radial outer ends and an outer ring (36) is connected to the vanes (32) at said radial outer ends, said impeller (12) has an additional peripheral rim of radially exteriorly directed additional vanes (101) on each of said opposite sides in said outer ring (36), said additional vanes (101) are spaced from each other in a circumferential direction, said additional vanes (101) of said additional rim together with said opposing walls (26,28) and/or said annular wall (30) form at least one flow duct (94) extending circumferentially in an at least partially circular arc-shaped manner around the rotation axis (13) of the impeller (12) so that a pressure build-up occurs in the rotation direction (11) of the impeller (12), the additional rim of said additional vanes (101) in said outer ring (36) of said impeller is divided into two rim portions of said additional vanes (101) on respective opposite sides of said outer ring (36), said two rim portions are separated from each other in an axial direction by an annular separating member (102) of said outer ring (36), and said additional vanes are arranged with equal spacing (e) in the rotation direction of said impeller (12) and are shaped to optimize fluid flow.

2. The aggregate as defined in claim 1, wherein each of said additional vanes (101) has a vane front surface (105) oriented substantially radially and facing in a rotation direction (104) of the impeller (12) and a vane back (106) extending rearwards from said vane front surface (105) in a circumferential direction around the outer ring (36) opposite to said rotation direction of said impeller (12) and said vane back (106) has a radial back height (a) continuously decreasing from a maximum (A) at said vane front surface (105) to a minimum (B) at an end of said vane back (106) remote from said vane front surface (105).

3. The aggregate as defined in claim 2, wherein said vane back (106) has an outer contour (107) and said outer contour (107) is arc-shaped or curved between said maximum (A) and said minimum (B) and has an intervening inflection point (W).

4. The aggregate as defined in claim 3, wherein said outer contour (107) has a curved shape such that respective tangents at said maximum (A) and said minimum (B) on said outer contour (107) each intersect at right angles with a radial line passing through the rotation axis (13) of the impeller (12).

5. The aggregate as defined in claim 3, wherein said inflection point (W) is located at about at least half of a maximum radial height (a/2) and at about at least half of a length (f/2) of the vane back (106).

6. The aggregate as defined in claim 2, wherein the vane front surface (105) extending from a radial surface edge **(105*a*) on an annular separating member (102) on the impeller is rotated out from a radial plane passing through the rotation axis (13) in the rotation direction (104) of the impeller (12) so that both a radially inner lower corner (C) of a front surface edge (105*b*) of the vane front surface (105) and the radially outer upper corner (D) of said front surface edge (105*b*) protrude in front of corresponding corners (E,F) of said radial surface edge (105*a*) in the rotation direction (104) of the impeller (12)**.

7. The aggregate as defined in claim 6, wherein a distance (h) of said upper corner (D) of said front surface edge **(105*b*) of said vane front surface (105) from said upper corner (F) of said radial surface edge (105*a*) is greater than a distance (g) between said lower corners (C,E) of both of said surface edges (105*b*,105*a*)**.

8. The aggregate as defined in claim 7, wherein an axial width (c) of each of said additional vanes (101) is approximately 0.75 to 1.25 times a sum of a maximum radial height (a) of said vane front surface (105) and a radial spacing (b) of said annular wall (30) of said pump chamber (24) of said annular separating member (102).

9. The aggregate as defined in claim 8, wherein said maximum radial height (a) of said vane back (106) is approximately from 0.2 mm to 0.5 mm, said radial spacing (b) between said annular wall (30) and said annular separating member (102) is between about 0.1 mm to 0.3 mm, a number of said additional vanes (101) in one of said rims is between 37 and 50 and a length (f) of said vane back (106) in a circumferential direction is about 0.5 to 0.75 times a vane spacing (e).

10. The aggregate as defined in claim 9, wherein said distance (h) of said upper corners (D,F) of both of said surface edges **(105*a*,105*b*) of said vane front surface (105) is approximately 0.5 to 0.8 times said radial spacing (b) between said annular separating member (102) of said outer ring (36) and said annular wall (30) of the pump chamber (24) and said spacing (g) of both of said lower corners (C,E) of said surface edges (105*a*,105*b*)** is about 0.2 to 0.5 times said radial spacing (b).

11. The aggregate as defined in claim 10, wherein at at least one position on a circumference of said annular wall (30) a radial gap (103) between said annular separating member (102) of said outer ring (36) of said impeller (12) and said annular wall (30) of said pump chamber (24) has a minimum value equal to between about 0.03 mm and 0.1 mm.

* * * * *